United States Patent [19]

Avery

[11] 4,156,999

[45] * Jun. 5, 1979

[54] BEAM FOR CONCRETE FORMING STRUCTURES

[75] Inventor: Peter J. Avery, Toronto, Canada

[73] Assignee: Aluma Building Systems, Inc., Ontario, Canada

[ * ] Notice: The portion of the term of this patent subsequent to Jan. 22, 1991, has been disclaimed.

[21] Appl. No.: 902,103

[22] Filed: May 2, 1978

Related U.S. Application Data

[60] Continuation of Ser. No. 422,874, Dec. 3, 1973, abandoned, which is a division of Ser. No. 204,132, Dec. 2, 1971, Pat. No. 3,787,020.

[51] Int. Cl.[2] ..... E04H 12/34; E04B 5/00

[52] U.S. Cl. ..... 52/376; 52/729; 52/731

[58] Field of Search ..... 249/13, 18, 23, 28, 249/34; 52/374, 376, 392, 626, 644, 710–712, 373–377, 729, 738

[56] References Cited

U.S. PATENT DOCUMENTS

| | | | |
|---|---|---|---|
| 1,586,053 | 5/1926 | Snyder | 52/738 |
| 2,182,015 | 12/1939 | Davis, Jr. | 52/376 |
| 3,336,708 | 8/1967 | Rambelle | 52/376 X |

FOREIGN PATENT DOCUMENTS

| | | | |
|---|---|---|---|
| 637844 | 5/1950 | United Kingdom | 52/376 |

*Primary Examiner*—Richard B. Lazarus
*Assistant Examiner*—John S. Brown
*Attorney, Agent, or Firm*—Donald E. Hewson; Ira C. Edell

[57] ABSTRACT

A concrete forming structure is provided wherein a pair of substantially parallel trusses have a plurality of beam members placed transversely across their upper end with a substantially planar upper deck secured to the upper edges of the beams. Each beam has an upper portion which comprises an open, inverted top hat section into which a wooden joist member may be forced and graspingly secured in snug manner. Panels, such as plywood, which are usually used for concrete forming, may be nailed or screwed to the concrete forming structure at the wooden joists engaged in the open top hat sections of the beams. The deflection resistance of a beam having a wooden joist graspingly and snugly secured therein is improved over that of an I-beam having a similar metal cross-section. When a floor panel poured on the concrete forming structure is cured, the structure may be lowered from beneath that panel and "flown" using known construction cranes to a position several storeys above the floor from which it had just been removed in order for a new floor panel to be poured on the emplaced concrete forming structure.

2 Claims, 9 Drawing Figures

5
16
14
61
46
44
56
5
18
40
22

20
40
68
72
20
70
16
54
64
64
61
50
52
14

46
62
60
44
58
16
54
50
61
64
66
52
14

BEAM FOR CONCRETE FORMING STRUCTURES

This is a continuation of application Ser. No. 422,874 filed Dec. 3, 1973, now abandoned, which is a division of Ser. No. 204,132, filed Dec. 2, 1971, now U.S. Pat. No. 3,787,020.

FIELD OF THE INVENTION

This invention relates to a concrete forming structure. In particular, the invention relates to a concrete forming structure for use in construction of buildings which have poured concrete floors, and is of the sort of concrete forming structure known as "flying forming".

BACKGROUND OF THE INVENTION

Very often buildings which are being constructed, particularly high-rise buildings, such as apartments and office buildings, have poured concrete floors. The thickness of the concrete which is poured to form a floor may be up to eight inches, depending on the span of the floor between supporting walls or structures, and sometimes higher. In any event, in most instances, concrete floors are poured in spans of up to eighteen feet, which spans are between supporting walls or pillars. However, during the construction of a high-rise building, it is necessary to provide forming structures to support each of the concrete floors as it is poured and for the next few days following when it is poured, so as to permit the concrete to cure sufficiently in order to remove the forming from beneath it.

Thus, most often, a concrete floor in a high-rise building is prepared by pouring the concrete on a form which is supported on the floor beneath the one being poured, and which provides a substantially flat or planar upper deck on which the concrete is poured. When the concrete forming is subsequently removed after the flooring has cured, each span of the floor is supported by columns or shear walls, having spans up to eighteen feet and sometimes greater, and having a depth which is the front to back dimension of the building being constructed. Very often, therefore, concrete floors are poured in bays between columns or supporting walls which may have dimensions of up to eighteen feet (or twenty feet) by up to eighty feet.

It is desirable to move the concrete forming structure on which the concrete floor is poured as easily as possible; and this is most easily accomplished by moving the concrete forming structure substantially as one integral structure. Otherwise, it is necessary to provide a plurality of forms including steel or wooden crib-like structures or scaffolding, individual plywood sheeting to form the deck on which the concrete is poured, etc. When the concrete forming structure can be moved in substantially one operation as one integral structure, labour costs can be considerably reduced—both in respect of set-up time and knock-down time—as well as in the use of labourers rather than semiskilled or skilled tradesmen and journeymen. Thus, flying forming systems have been developed whereby a concrete forming structure is built as a single, monolithic or integral structure having trusses, beams and a deck set up as a single entity. The flying form is so called because it can be "flown" from one bay to another using tower or self-climbing cranes of the type well known in the construction industry. A high-rise building may therefore be constructed using a plurality of flying forming structures as concrete forming structures in the following manner:

When the first floor at or slightly above ground level has been poured on suitable concrete forming structures, a plurality of flying forms are placed on it, one or more for each bay as discussed hereafter, depending on the type of flying form and depending on the materials to be used. In any event, the second floor to be poured—i.e. the first floor to be poured using the flying forms—together with the appropriate walls or columns, are then poured using the flying forms as well as appropriate wall or column forms, as required. In the usual case, a second set of flying forms is then placed on the concrete floor after sufficient time has passed that the curing concrete will at least support the weight of the concrete forming structure or flying form to be placed on it, as well as the weight and impact of boots, etc. of the workers. Suitable column or wall forms are also placed, and the second poured concrete floor is formed. At this time, the first poured concrete floor may be sufficiently cured to permit removal from beneath it of the first set of concrete forming structures—the flying forms—on which that floor has been poured. Otherwise, a third set of flying forms is placed on the second poured floor using suitable tower or self-climbing cranes—together with the appropriate column or wall forms—and a third concrete floor is thereby poured. Usually, by this time, the first floor which was poured has sufficiently cured to permit removal of the first set of flying forms, if they have not already been removed for construction of the third floor.

In order to remove the flying forms, they are first lowered from the underside of the concrete floor which was poured on them, and then they are pushed outwardly from the building and secured to suitable cables extending downwardly from the outwardly extending arm of a crane. Each form is then flown by lifting it upwardly with the crane and placing it on the last-to-be-poured concrete floor, together with appropriate column or wall forms, for use as a concrete forming structure on which yet another concrete floor is to be poured. Therefore, in the usual case, a flying form is used as a concrete forming structure in a bay which may be many storeys high, by "leap-frogging" the flying form past one or two other flying forms and placing it on the then uppermost poured concrete floor in order that yet another floor can be poured on it, and so on. Thus, as few as two—and usually three—flying forms per bay may be required for the construction of a multi-storeyed high-rise building.

It has been found, however, when flying forms are heavy, and tower or self-climbing cranes are restricted as to the weight that they can handle—particularly when the lifting point is considerably far out on the horizontal lifting arm of the crane, that this can be overcome by the use of flying forms as concrete forming structures when the flying forms comprise truss and beam members which are formed of aluminum. In any event, however, this invention provides a flying form as a concrete forming structure wherein the deck on which the concrete is poured is easily and readily secured to the upper edges of a plurality of beams which are set transversely across a pair of truss members. This latter advantage is gained by providing a beam structure having an upper section in the form of an inverted top hat which is open at its upper end and which is adapted to graspingly secure wooden joist members which may be driven downwardly into the top hat open section and to which the panels comprising the upper deck may be fastened using drivable fastening means, such as nails or screws.

BRIEF SUMMARY OF THE INVENTION

It is a purpose of this invention to provide a concrete forming structure comprising beams and trusses and a substantially planar deck on which concrete may be poured and which may be moved substantially as an integral structure; wherein beam structures are provided by which the upper deck can be readily and easily secured to the beams.

A further object of this invention is to provide a concrete forming structure which is useful as a "flying form" for use in the construction of high-rise buildings, and to teach a method of construction using such concrete forming structures.

A still further object of this invention is to provide a concrete forming structure which may be formed of aluminum and whose size may be greatly increased over similar structures formed of steel or wood.

Yet another object of this invention is to provide a concrete forming structure in which means to support the structure and to adjust it for desired levels and heights are provided.

BRIEF DESCRIPTION OF THE DRAWINGS

These and other purposes, objects and features of this invention are discussed in greater detail hereafter in association with the accompanying drawings, in which.

DESCRIPTION OF THE PREFERRED EMBODIMENTS

Figure 1:
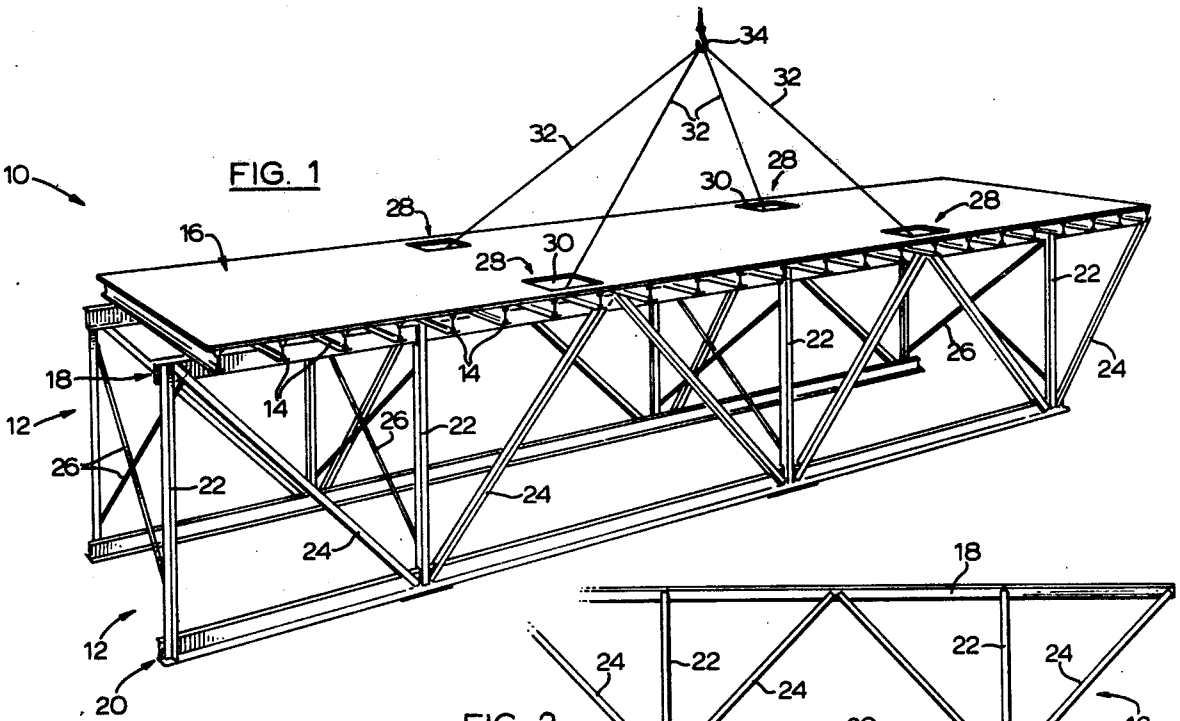
FIG. 1 is a perspective view showing a portion of a concrete forming structure according to this invention, in use as a flying form.

A flying form which is useful as a concrete forming structure, as discussed above, is shown in FIG. 1 and is indicated generally at 10. The concrete forming structure comprises a plurality of trusses indicated generally at 12, a plurality of beams indicated generally at 14, and an upper deck indicated generally at 16. Each truss has upper and lower beam members 18 and 20, vertical columns 22, chords 24 and cross-tierods 26. The flying form has pickup points indicated at 28 in openings or ports 30, and is adapted to be picked up by a saddle comprising cables 32 suspended from hook 34. Each end of the truss may have a chord 24 as shown at the right end of the structure 10 in FIG. 1, or a column 22 as shown at the left end of the same structure, depending on its length and other design considerations. In any event, it will be seen that the flying form 10 is an integral structure comprising in this case, two substantially parallel trusses 12 having beams 14 placed transversely across the upper ends of the trusses on upper beam members 18 thereof, and with an upper deck 16 secured to the upper edges of the beams 14.

Figure 2:
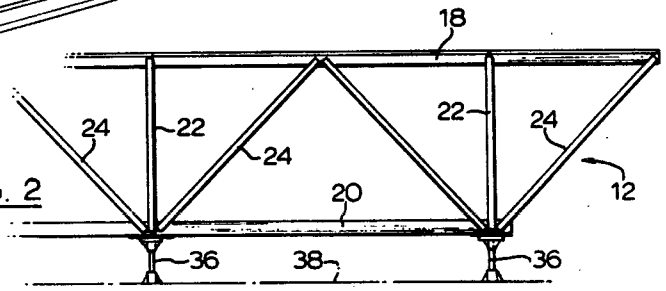
FIG. 2 is a side view of a portion of a truss of a concrete forming structure according to this invention.

FIG. 2 is a partial view showing the side of a truss portion of a concrete forming structure according to this invention, wherein the lower end of the truss 12 is supported by screwjacks 36 placed beneath the lower beam member 20 of the truss 12. In this case, the screwjacks 36 are shown placed substantially beneath the lower ends of the vertical truss columns 22 and below the attachment points of the columns 22 and chords 24 to the lower beam member 20 in order to take up the vertical loading. Screwjacks such as 36 are used beneath the trusses 12 of a flying form 10 in order to adjust the height of the upper deck 16 above the floor—such as that indicated at 38 in FIG. 2—on which the flying form 10 is located; thereby accommodating adjustment of the height of the lower side of a poured concrete floor above the upper side of the next lower poured concrete floor.

Figure 3:
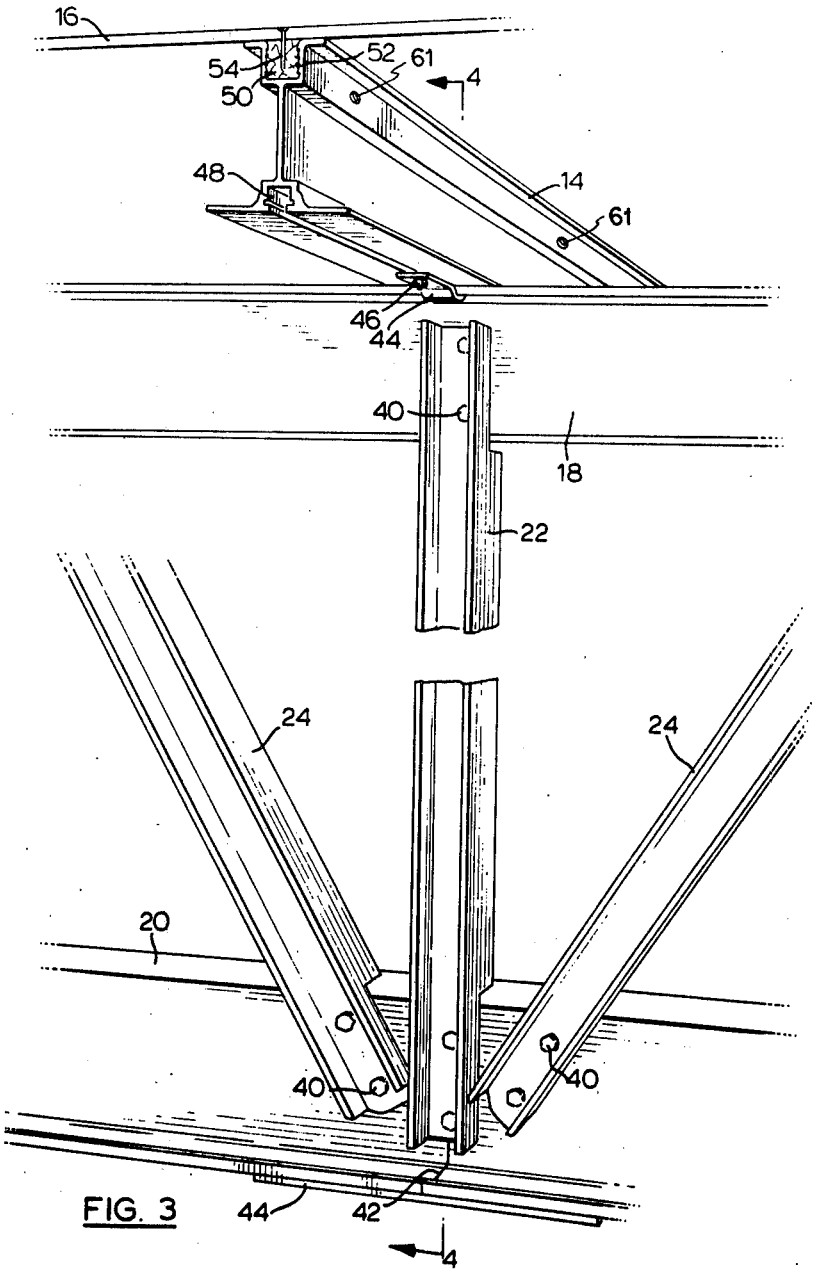
FIG. 3 is a perspective view to a much larger scale showing details of the truss and beam assembly of a concrete forming structure according to this invention.

It will be noted in FIG. 1 that the outer ends of the beams 14 extend beyond the upper beam members 18 of trusses 12. The sideways span of the concrete forming structure—and thus, of the concrete floor which may be poured on that structure—may thus be determined by the allowable limit to which the beams 14 may be permitted to extend or cantilever beyond the beam members 18, considering the concrete and other static loads which the structure is designed to withstand. Turning to FIG. 3, the construction of a concrete forming structure according to this invention is illustrated in greater detail—as well as in FIGS. 4 to 8—and the following discussion is intended as exemplary of concrete forming structures according to this invention, particularly ones employing upper beam members in accordance with the present invention.

For ease of assembly at the construction site, especially when the concrete forming structure is fabricated from aluminum as discussed hereafter, the entire concrete forming structure may be bolted together using the well-known techniques. Thus, each of the truss columns 22 or chord members 24 may be bolted to the upper or lower beam members 18 or 20 using bolts 40. A seam is indicated at 42 in FIG. 3 in the lower beam member 20 of the truss, and a plate 44 is shown beneath the underside of the structural members which comprise the lower beam member 20. Alternative embodiments and arrangements are discussed hereafter. The beam 14, which comprises one of the plurality of beams placed transversely across the upper ends of a pair of substantially parallel trusses 12, may be secured to the upper beam member 18 of the truss by bolting it thereto. Such arrangements may include bolts passed through the lower flange of the beam 14 and the upper flange of the beam 18, or they may include brackets 44 secured by bolts 46 within channels 48 formed in the beam 14. The upper deck 16 is shown secured to a wooden joist member 50 placed in an upper, open and inverted top hat section 52 of the beam 14, by nail 54. This arrangement is discussed in greater detail hereafter.

Figures 4, 5, 6:
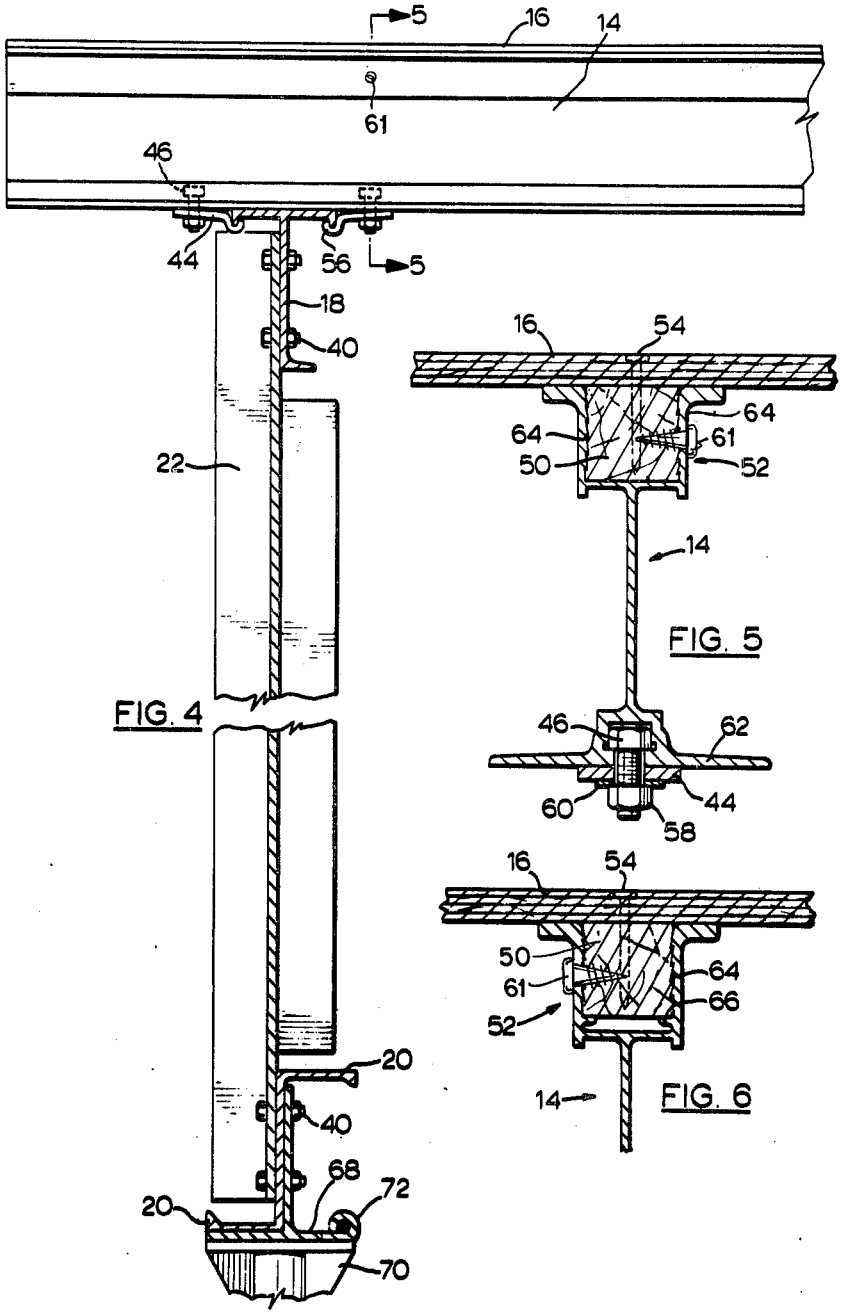
FIG. 4 is a sectional view along the line 4—4 in FIG. 3.
FIG. 5 is a sectional view along the line 5—5 in FIG. 4.
FIG. 6 is a sectional view of the upper portion of a structure similar to that shown in FIG. 5.

In FIG. 4 are further details of the bolting arrangements whereby the truss 12 is formed; including the truss column 22, the upper beam member 18, the lower Z-shaped beam member 20, bolts 40 with suitable nuts and locking arrangements as are well known in the art, brackets 44 and bolts 46 securing beam 14 to upper beam member 18, etc. It will be noted that the brackets 44 are adapted to secure the beam 14 to the beam member 18 by a substantially hook-like formation 56 at the end of the bracket 44.

Referring to the lower portion of the beam member 14 illustrated in FIG. 5, it will be seen that tightening of the nut 58 on bolt 46 against washer 60 and thus against the bracket 44 thereby brings the bracket 44 into intimate engagement with the lower side of the lower flange 62 of the beam 14. Movement of the beam 14 in any direction is thereby substantially precluded.

It should be noted that the beam 14 is a modified I-beam; and indeed, as noted above, the lower portion of the beam 14 may be substantially that of a wide flange I-Beam. Suitable bolting arrangements can be made to secure the lower flange of the I-beam to the upper flange of the modified T-beam section of upper beam member 18 of truss 12.

More importantly, the upper portion of the beam 14 has an upper section in the form of an inverted top hat which is open at its upper end. This is indicated generally at 52, and a wooden joist member 50 is shown placed in the open top hat section 52 in the upper portion of the beam 14. A suitable panel such as a sheet of plywood is used to form the upper deck 16, and may be secured to the wooden joist 50 by drivable means such as a nail or screw 54.

The inverted top hat section in the upper portion of the beam 14 may have a plurality of ridges 64 formed in each side thereof. The ridges are shaped so as to grip the side of the wooden joist member 50; and may have a downwardly directed saw tooth configuration, or they may simply be ridges which extend inwardly into the wooden joist member 50 thereby slightly compressing the material thereof in the vicinity of the ridges. Typically, the inverted top hat open section 52 at the upper end of a beam 14 is dimensioned so as to take a wooden joist member of construction grade lumber, nominally 2 inches by 2 inches in cross section. The wooden joist member 50 may be forced into the open top hat section by hammering the wood downwardly into the section, and when it is installed, upward motion thereof is essentially precluded by the interference of the ridges 64 with the sides of the wooden joist member 50. As noted, the panels of the upper decking 16 may be secured to the joist member 50 by a drivable means such as a nail or screw indicated at 54.

FIG. 6 shows an alternative arrangement for an open inverted top hat section in the upper portion of a beam. In this case, stops 66 are formed to extend into the top hat section to preclude downward movement of the wooden joist member 50 past the stops 66. This cross section is used where it is otherwise desired to have a different web arrangement in the extruded section forming the beam 14, with a different cross sectional area, etc. Otherwise, the operation and action of the beam is the same as discussed above.

It should be noted that the transverse beam members 14—which are essentially I-beams having an open, inverted top hat section in their upper portion—have increased resistance to deflection when a wooden joist member is graspingly and snugly secured in the top hat section as discussed above, when compared with a standard I-beam configuration having identical cross sectional area of metal. Indeed, the deflection resistance of an extruded aluminum I-beam section similar to that shown in FIG. 5 and indicated in FIG. 6, with a wooden joist member snugly secured in the top hat section, is better than that of a standard I-beam made of steel and having equal weight per linear foot.

Figure 7:
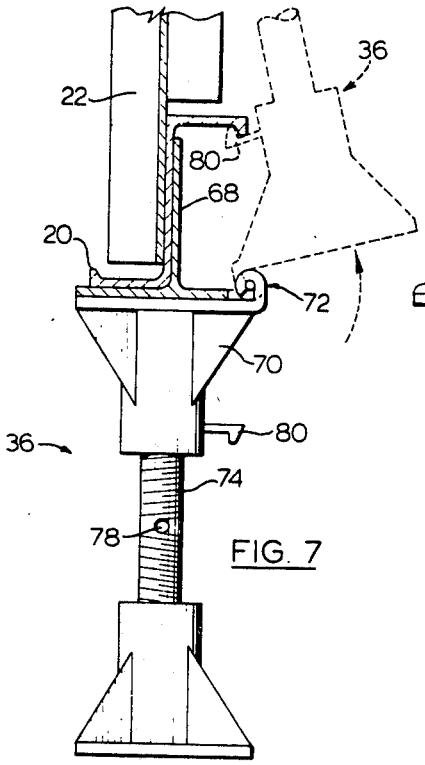
FIG. 7 is a view showing an arrangement of a supporting structure at the lower end of the truss column shown in FIG. 4, with the supporting structure shown in a position swung away from beneath the truss column in ghosted lines.
Figure 8:
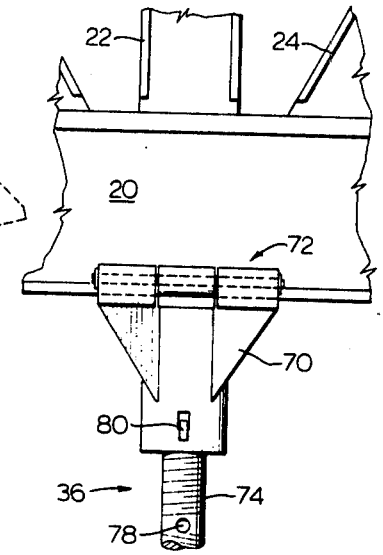
FIG. 8 is a partial side view of the structure of FIG. 7.

As indicated above, screw jack means 36 may be installed to support the lower ends of the trusses 12; and one such screw jack arrangement is shown, particularly in FIGS. 7 and 8, and also partially in FIG. 4. It is noted that the lower beam member 20 of the truss has substantially Z-shaped configuration, and a further member having a modified T-configuration, shown at 68, is bolted to the lower beam member. The upper end or top 70 of the screw jack is hingedly secured to the member 68 at hinge 72—which conveniently comprises a hinge pin and hinge flanges as shown in FIGS. 4, 7 and 8. A post 74 having a screw thread at each end is received in the top 70 and a base 76 which are threaded, at least in part, so that the post 74 may be turned thereby causing advance or withdrawal from each of the top 70 and base 76. Conveniently, the post 74 may be turned by inserting a suitable rod through a hole placed near the center of the post, at 78. A catch 80—which may be spring urged—may be provided so as to secure the screw jack 36 when it is swung away from a position beneath the lower beam member 20. This is indicated in ghost lines in FIG. 7, which is a typical portion, other clasp means may be on column 22.

Figure 9:
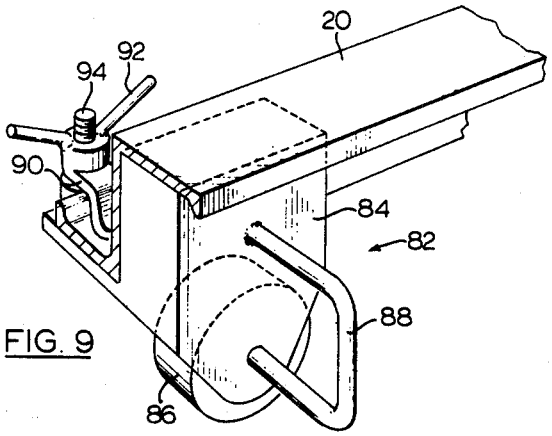
FIG. 9 is a perspective view showing a portion of a lower beam member of a truss having a beam roller installed thereon.

FIG. 9 illustrates the installation of a beam roller indicated generally at 82 on a lower member 20 of a truss. The beam roller comprises a body 84 in which a wheel or set of wheels 86 is rotatably journalled; and has a handle 88 on the one side thereof. On the opposite side of the body, adapted to fit over the lower outwardly extending flange of the Z-shaped beam member 20, is a bracket 90 which is secured to the beam roller by such means as wing nut 92 threadably engaged with bolt 94. It can be seen that the beam roller 82 is thereby adapted for portability—to be carried by the handle 88—and to be easily and quickly installed and removed from the lower beam member 20 of a truss. The operation of the beam roller 82, and the supporting screw jacks 36 with the concrete forming structure 10 is as follows.

It has been noted above that the use of a flying form as a concrete forming structure requires the movement of the flying form as a single, integral structure itself. While several forms may be placed end to end in a long bay, nevertheless handling of individual scaffolding and planking, etc., is precluded and the set-up time is considerably reduced. However, in order for a flying form to be removed from beneath a cured concrete floor panel which had been poured on the upper deck of the flying form, means must be provided to reduce its height. Such means may conveniently be screw jacks such as those indicated at 36 and discussed with reference particularly to FIGS. 7 and 8. Having lowered the flying form away from the concrete panel formed above it, it is then necessary to push the form outwards away from the building and to "fly" it upwards to its next working position. Therefore, means must be provided to permit the form to be rolled; and such means are accomplished by such as the beam roller 82 discussed above with respect to FIG. 9. In any event, it will be seen that roller means are required only to move the form, i.e. to pull it out from the bay in which it was last used, and possibly to assist in positioning it at its next-to-be-used position. Therefore, considerably fewer beam rollers 82 are required than concrete forming structures 10, since they are in use only a short period of time for each concrete forming structure. Since some considerable time may be required to completely pour a concrete floor in a large high-rise building, it will thus be seen that beam rollers, and indeed, crews, can constantly be kept occupied moving flying forms—at the same rate as bays of concrete floor are poured on newly installed flying forms. The flying form can be lifted as indicated in FIG. 1, and may be suspended from a tower or self-climbing crane during the lifting operation.

When a flying form is constructed according to the examples and embodiments discussed above and shown in the Figures, and the truss and beam members are formed of extruded aluminum sections, very strong and light-weight flying forms are possible. For example, flying forms having deck areas up to 1,600 square feet (20 feet by 80 feet) and weighing about 5 pounds per square foot can be built, and such flying forms can be moved by tower or self-climbing cranes of known design. A similar flying form made of steel would weight twice as much per square foot; and because of the weight limitations placed on tower or self-climbing cranes, steel flying forms can be made which are not any longer than 40 feet. Thus, twice as much handling may be required when the concrete forming structures (flying forms) are made of steel than when they are made of aluminum. If the flying form is made of wood, wooden joists two inches by 12 inches must be placed at 12 inch centers, and a weight factor per square foot of wooden flying forms relative to aluminum flying form of 2.5 (2.0 with steel) thereby effectively precludes the use of wood as a structural material in the production of flying forms.

It will be appreciated that construction costs can be considerably reduced by using flying forms in accordance with this invention. Particularly, the reduction in the number of skilled and semi-skilled workmen can be effected, as well as a reduction in capital outlay or rental costs for concrete forming equipment. Further, there is considerably less wastage of materials, it being necessary only to replace the decking and wooden joist members, and even then only occasionally. The scrap value of aluminum relative to its new price is considerably higher than the scrap value of steel relative to its new price; and lighter and larger structures which require less handling can be prepared from aluminum as compared with steel. Because of the bolted assembly of the flying form, the concrete forming structure may be shipped to the construction site in knocked-down condition for assembly "on the job".

The use of a beam having an open, inverted top hat section at its upper end which is adapted to graspingly secure and snugly engage a wooden joist member which may be forced thereinto, enhances the deflection resistance of the beam, thereby permitting wide cantilever extensions of the beam beyond the trusses across which a number of transverse beams are secured. Further, by using the wooden joist member, the panels which comprise the deck of the concrete forming structure may be easily secured to the structure merely by nailing the same using nails driven into the wooden joist members. Thus, the decking may be easily repaired or replaced, without regard to expensive or complicated fastening arrangements for the wooden panels to aluminum or steel supporting structures. The screw jacks which are discussed above may be replaced with conventional screw jacks or other means such as hydraulic jacks, so long as means are provided whereby the height of the concrete forming structure can be reduced after a concrete floor panel poured on its upper deck has cured, so as to permit removal of the concrete forming structure from beneath the cured floor panel and emplacement of the concrete forming structure as a flying form in another position to be used again.

The above description and the accompanying drawings relate to specific embodiments of flying form structures; and it is obvious that other changes and amendments with respect to the structure, its nature of assembly and the materials used can be made without departing from the spirit or scope of the appended claims. For example, nails or other suitable fastening means such as self-tapping screws 61 may be driven through suitable openings in the sides of the top hat section of the beams 14, especially to preclude lateral motion of the joist member 50, as well as to further preclude upward movement of the joist member 50—such as when the decking 16 is being replaced, which may require ripping the old decking panels away from the joist member 50. Also, suitable pickups or lifting brackets may be provided other than as indicated generally at pickup points 28 in openings 30.

Use of a truss having upper and lower beams as well as truss columns and cords permits easy adjustment of the length of any truss and therefore of any concrete forming structure by merely adding or removing additional cords, columns and beam members.

What I claim is:

1. An extruded unitary aluminum beam of uniform cross-section, having a base portion, an inverted top hat portion, and a centrally located web portion between said base and top hat portions;

said inverted top hat portion presenting an open channel portion along the entire length of said beam and having a bottom wall connected centrally to said web portion and extending generally perpendicular thereto, side walls extending upwardly from said bottom wall; and a load-supporting portion of said beam consisting of a pair of flanges extending laterally outwardly, one from the top of each of said side wall;

said base portion having a first wall connected centrally to said web portion and extending generally perpendicular thereto, a pair of side walls extending generally downwardly from said first wall, a first pair of flanges extending laterally inwardly, one from the bottom of each of said pair of downwardly extending side walls, so that said first wall and said downwardly extending side walls and said inwardly extending flanges define a centrally disposed generally T-shaped downwardly open slot, said slot being suitable for receiving and retaining a bolt head while permitting the shank of the bolt to project downwardly from the open slot; and a pair of base flanges extending laterally outwardly, one from the bottom of each said pair of downwardly extending side walls and defining a load-transmitting side of said beam;

said web portion of said beam being formed between said base and top hat portions so as to be able to transfer load forces from the load-supporting portion of said beam to said load-transmitting side of said beam, at any point along the length of said beam;

wherein the width and height of said channel presented by said inverted top hat portion are each substantially greater than the width and height, respectively, of said T-shaped slot;

the thickness of said top hat flanges in the direction towards said base portion being greater than the thickness of the side walls of said open channel portion of said inverted top hat portion;

the overall distance between the outer extremities of said base flanges being greater than the overall distance between the outer extremities of said top hat flanges; and wooden beam-stiffening joist means suitable for receiving driveable fastening means and having a substantially rectangular cross-section with a cross-wise dimension substantially equal to the average spacing between said side walls of said open channel portion of said inverted top hat portion, said beam-stiffening joist means being force fitted into said open channel portion of said top hat portion and being mounted in and extending throughout the length of said open channel and being secured in said open channel by driveable means passing through said projecting inwardly from at least one of said side walls of said open channel portion, so as to thereby preclude the inadvertent removal of said beam-stiffening joist means from said open channel portion;

the height of said wooden beam-stiffening joist means having as a maximum limitation the height of said side walls of said open channel portion of said top hat portion.

2. The beam according to claim 1, wherein said side walls of said open channel portion of said inverted top hat portion are substantially parallel to each other.

* * * * *

REEXAMINATION CERTIFICATE (430th)

United States Patent [19]

Avery

[11] B1 4,156,999

[45] Certificate Issued * Dec. 10, 1985

[54] BEAM FOR CONCRETE FORMING STRUCTURES

[75] Inventor: Peter J. Avery, Toronto, Canada

[73] Assignee: Aluma Building Systems, Inc., Ontario, Canada

Reexamination Reqs:st:
No. 90/000,452, Oct. 4, 1983
No. 90/000,511, Feb. 27, 1984

Reexamination Certificate for:

| | |
|---|---|
| Patent No.: | **4,156,999** |
| Issued: | **Jun. 5, 1979** |
| Appl. No.: | **902,103** |
| Filed: | **May 2, 1978** |

[ * ] Notice: The portion of the term of this patent subsequent to Jan. 22, 1991 has been disclaimed.

Related U.S. Application Data

[60] Continuation of Ser. No. 422,874, Dec. 3, 1973, abandoned, which is a division of Ser. No. 204,132, Dec. 2, 1971, Pat. No. 3,787,020.

[51] Int. Cl.[4] ..... E04H 12/34; E04B 5/00

[52] U.S. Cl. ..... 52/376; 52/729; 52/731

[58] Field of Search ..... 52/376, 729, 364, 368

[56] References Cited

U.S. PATENT DOCUMENTS

| | | | |
|---|---|---|---|
| 320,079 | 6/1885 | Martin | 52/376 |
| 384,421 | 6/1888 | Brown | 52/364 |
| 385,624 | 7/1888 | Hodges | 52/376 |
| 1,475,409 | 11/1923 | Riddle . | |
| 1,586,053 | 6/1925 | Snyder | 52/738 |
| 1,619,300 | 3/1927 | Klaasen | 52/376 |
| 1,694,514 | 12/1928 | Naugle et al. | 52/376 |
| 2,085,472 | 6/1937 | Roush | 52/376 |
| 2,167,836 | 8/1939 | Greulich | 52/376 |
| 2,182,015 | 12/1939 | Davis | 52/376 |
| 3,203,151 | 8/1965 | Bransford, Jr. | 52/729 |
| 3,336,708 | 8/1967 | Rambelle | 52/376 X |
| 3,385,557 | 5/1968 | Rambelle | 52/363 |
| 3,438,160 | 4/1969 | Gostling | 52/126.7 |

FOREIGN PATENT DOCUMENTS

| | | | |
|---|---|---|---|
| 120906 | 1/1946 | Australia | 52/364 |
| 804716 | 3/1951 | Fed. Rep. of Germany . | |
| 13332 | of 1894 | United Kingdom | 52/376 |
| 637844 | 5/1950 | United Kingdom . | |
| 650239 | 2/1951 | United Kingdom . | |

OTHER PUBLICATIONS

Young, E. W., "Strains on Girders, Arches & Trusses," MacMillan & Co., London, 1873, p. 21.

"Anthes Zipspan", Publication No. S1028-10M-9-70, Published by Anthes Equipment Limited, Port Credit, Ontario, Canada, 1970, (2 pages).

Alcan Shape Design Manual, (3 pages), Aluminum Limited, Oct. 1964.

*Primary Examiner*—Alfred C. Perham

[57] ABSTRACT

A concrete forming structure is provided wherein a pair of substantially parallel trusses have a plurality of beam members placed transversely across their upper end with a substantially planar upper deck secured to the upper edges of the beams. Each beam has an upper portion which comprises an open, inverted top hat section into which a wooden joist member may be forced and graspingly secured in snug manner. Panels, such as plywood, which are usually used for concrete forming, may be nailed or screwed to the concrete forming structure at the wooden joists engaged in the open top hat sections of the beams. The deflection resistance of a beam having a wooden joist graspingly and snugly secured therein is improved over that of an I-beam having a similar metal cross-section. When a floor panel poured on the concrete forming structure is cured, the structure may be lowered from beneath that panel and "flown" using known construction cranes to a position several storeys above the floor from which it had just been removed in order for a new floor panel to be poured on the emplaced concrete forming structure.

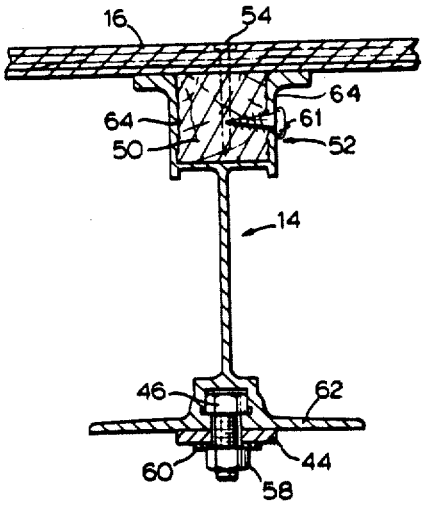

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 is confirmed.

* * * * *